US008393859B1

(12) United States Patent
Dillon

(10) Patent No.: US 8,393,859 B1
(45) Date of Patent: Mar. 12, 2013

(54) CARD SEAL FOR A TURBINE

(75) Inventor: Daniel R Dillon, West Palm Beach, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 845 days.

(21) Appl. No.: 12/562,249

(22) Filed: Sep. 18, 2009

(51) Int. Cl.
*F01D 11/02* (2006.01)
*F04D 29/10* (2006.01)

(52) U.S. Cl. ..... 415/173.5; 415/174.5; 415/230; 277/355

(58) Field of Classification Search ..... 415/173.3, 415/173.5, 174.2, 174.5, 230, 231; 277/355
See application file for complete search history.

(56) References Cited

U.S. PATENT DOCUMENTS

| | | | | |
|---|---|---|---|---|
| 6,267,381 | B1 * | 7/2001 | Wright | 277/355 |
| 7,703,774 | B2 * | 4/2010 | Awtar et al. | 277/412 |
| 8,333,544 | B1 * | 12/2012 | Pelfrey | 415/1 |
| 2008/0107525 | A1 * | 5/2008 | Adis et al. | 415/230 |

* cited by examiner

*Primary Examiner* — Edward Look
*Assistant Examiner* — Jason Davis
(74) *Attorney, Agent, or Firm* — John Ryznic

(57) ABSTRACT

A card seal with an annular arrangement of cards that form the card seal, where the cards are interweaved and staggered to increase a sealing capability of the cards. The card seal is formed from leading edge cards staggered with trailing edge cards, and the cards have a thicker outer end and a thinner inner end where the interweaving occurs. Because of the varying thickness of the staggered cards, each card has a taper on the lower outer end that decreases from a high to a low on the inner side in order that a foot print for the card is constant across the bottom surface that floats on the rotating part.

10 Claims, 1 Drawing Sheet

CARD SEAL FOR A TURBINE

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a dynamic seal, and more specifically to card seal for use in turbo machines such as gas turbines, steam turbines, compressors, pumps, etc.

2. Description of the Related Art including information disclosed under 37 CFR 1.97 and 1.98

A gas turbine engine includes a compressor and a turbine each having multiple rows of rotor blades interspaced between stator or guide vanes. In-between each row or stage, a large pressure differential is formed. In the compressor, the pressure increases in the flow direction while in the turbine the pressure decreases. The pressure differential between adjacent stages in the compressor is smaller than in the turbine because of the greater number of stages used in the compressor.

A dynamic seal is used between the rotor and the stator of the turbomachine to limit leakage in order to improve the efficiency of the turbo machine. In the turbine, the leakage is from the hot gas flow passing through the turbine. Hot gas leaking into the rim cavity will expose the rotor disks to the extreme hot temperature. Thus, better seals reduce leakage to increase performance of the turbo machine and to prevent over-exposure of turbomachine parts from excessive temperatures. In one example, the rotor disks in the turbine are made from a high strength material different than the rotor blades or stator vanes that would develop cracks due to thermal stress loads if exposed to high temperature from excessive hot gas leakage into the adjacent rim cavity. This is why purge air is often used in the rim cavities to push out or dilute and hot gas flow leakage that leaks through the dynamic seal and into the rim cavity.

In a turbine of a gas turbine engine, labyrinth seals or brush seals are used for the dynamic seals. In some cases, a combination of brush and labyrinth seals is used because of the characteristics of each. A labyrinth seal makes a good seal at relatively high rotational speeds while the brush seal is best for relatively low rotational speeds. This is due to the use of brushes that rub against the rotating part formed by the dynamic seal. As higher rotational speeds, the brushes will wear out early. Brush seals have less leakage than labyrinth seals, but wear out easily when rubbing at higher speeds. One reason why a turbine uses combinations of lab and brush seals is due to engine transients, which is when the engine is stopped and then restarted. The rotor shaft and the engine casing are made of different materials that have different coefficients of thermal expansion. Thus, the parts grow in a radial direction at different rates due to heat transfer to or from the part. Labyrinth seals are also capable of sealing much higher pressure differentials than brush seals.

A card seal is formed of a number of flat cards (also referred to as leafs or plates) arranged around a rotor shaft in an annular formation in which a gap formed between adjacent cards due to surface irregularities and is generally parallel to the rotor shaft axis. Each card is capable of sliding over adjacent cards so as to maintain contact with the rotor shaft surface or float on top thereof. An outer end of the cards is held in a casing while the inner ends float or make contact with the outer surface of the rotor shaft. One side of the cards is exposed to the high pressure side while the other side is exposed to the low pressure. U.S. Pat. No. 6,736,597 issued to Uehara et al on May 18, 2004 and entitled AXIS SEAL MECHANISM AND TURBINE shows one such card seal. This card seal will allow for too much leakage through the small gaps formed between adjacent cards to be useful in the gas turbine engine.

Leaf or card seals have been developed in order to provide a better seal that includes benefits from both the lab seals and the brush seals. Card seals are primarily utilized to maintain a pressure barrier between two cavities created by a static structure, a moving structure and separated by the seal structure as seen in FIG. 2. Specifically, a static cylindrical case, a rotor and the seal. Whereas a solid seal structure—such as a ring seal—would undergo severe contact loads due to rotor lateral excursions, card seals are designed to be compliant and either tolerates small contact or bond out of the rotor path.

The prior art card seal structures includes a plurality of thin cards arranged so that the weak axis of bending is presented in the direction of rotor motion. A tilt or lean in direction of motion is included so that contact occurs at an angle to the direction of motion as seen in FIG. 13. The net effect of these two features is to minimize wear by reduced contact load and actualize displacement due to boundary layer air pressure which will provide an air cushion between moving surface and free edge of the cards if a flexible card is used.

Therefore, by design, the plurality of cards that form the card seal provides for a direct leakage path between the cards. For this reason, the cards are reinforced along the card longitudinal axis by either changing the card number density or forming a localized deformation such as dimpling or ridges on each thin card that align with each other. A prior art card shows a card with a raised middle portion that extends along the longitudinal axis of the card that will reinforce the card and provide a barrier to the direct leakage flow path between the flat cards of FIG. 4. In the prior art, two adjacent cards each with a ridge projecting from one side of the thin card. The leakage area in this card seal is reduced by the cross sectional area of the ridge. However, the ridge or stamped process may effectively increase the weak axis inertia and impede the card's ability to bend away from the rotor lateral excursions. In other words, the cards having the ridges for added sealing and strength will produce a more rigid (or, less flexible) card seal.

BRIEF SUMMARY OF THE INVENTION

It is an object of the present invention to provide for a card seal with better leakage control through the cards than in the prior art card seals.

It is another object of the present invention to provide for a card seal that reduces the leakage flow path between the individual cards without a significant increase to overall card stiffness relative to the prior art card seals.

It is another object of the present invention to provide for a card seal that minimizes leakage while also minimizing stiffness.

It is another object of the present invention to provide for a card seal with interweaved staggered cards that have a constant foot print on the sealing surface.

The above described objectives and more are achieved with the card seal of the present invention in which the cards are staggered and interweaved in order to reduce leakage flow through adjacent cards, and where the cards have leading and trailing ends that are thicker than the inner ends that overlap one another. The cards have a tapered lower end on the outer sides in order that a footprint on each cards has a constant width across the bottom surface that floats on the rotating surface to form the seal therewith.

DETAILED DESCRIPTION OF THE INVENTION

Figure 1:
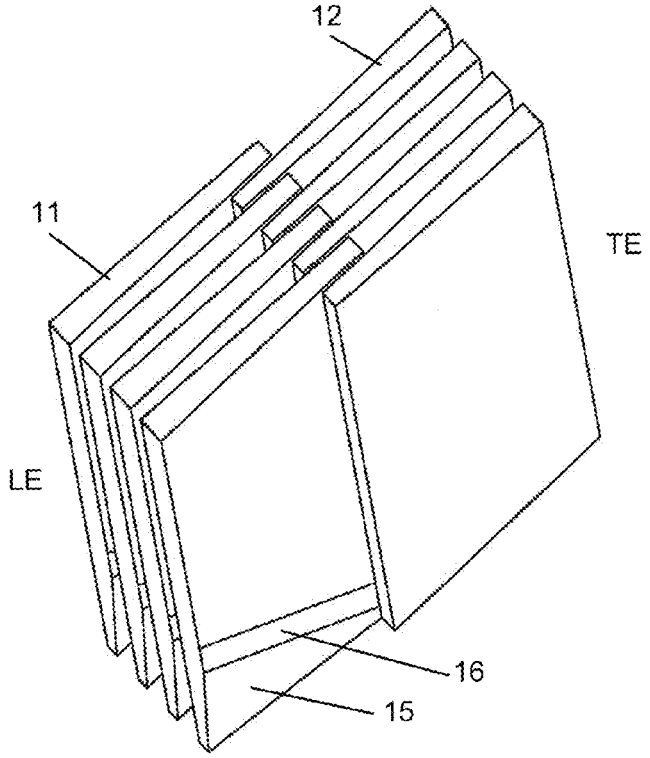
FIG. 1 shows an isometric view of a plurality of cards assembled in an inter-weaved and staggered arrangement according to the present invention
Figure 2:
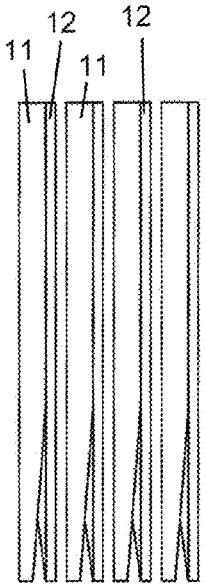
FIG. 2 shows a side view of several cards stacked together in FIG. 1.
Figure 3:
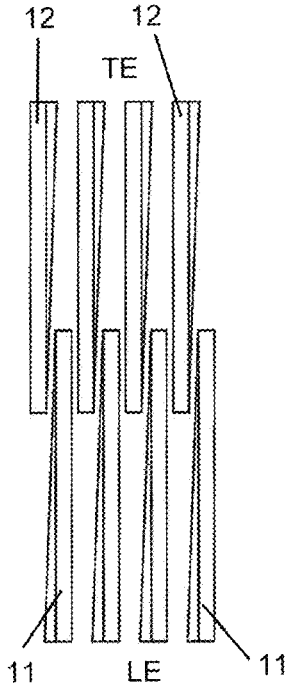
FIG. 3 shows a bottom view of several cards stacked together in FIG. 1 in which the foot print of each card can be seen.

The card or leaf seal of the present invention is shown in FIGS. 1-3 where in FIG. 1 is shown a number of cards are stacked together to form the card seal. The card seal is made up of two alternating sections of cards that include an upstream or leading edge card 11 and a downstream or trailing edge card 12 when measured in the direction of the high pressure to the low pressure of the fluid in which the card seal forms a seal.

One feature of the invention is that the cards do not have a constant thickness from front to back. The card thickness is greatest on the leading edge and trailing edge, while the inner edge where the interweaving occurs is the thinnest section. FIG. 3 shows this feature best. Here, the leading edge cards 11 are thicker on the bottom of this figure that in the interweaved section, and the trailing edge cards are thicker on the top of this figure with the thinner section being at the bottom of the card in the interweaved section. The foot print of each card is represented in FIG. 3 by the rectangular shapes. The triangle shapes represent the taper 15 shown in FIG. 1 of each card that allows for a constant foot print for each card across the lower surface. As seen in FIG. 1, the taper 15 of the leading edge card faces the front of the figure. The taper of the card in front of the leading edge card (the trailing edge card) would face toward the taper 15 that is shown in FIG. 1. Thus, the non tapered faces of the leading edge and trailing edge cards would also face each other. FIG. 3 shows these features as well.

FIG. 2 shows a side view of the stack of interweaved and staggered cards with the leading edge cards 11 having a thicker side than the trailing edge cards 12. The taper 15 on the outer sides and bottom end of each card is shown in FIGS. 1 and 2. The taper 15 includes a fillet transition 16 between the flat surface of the front of the card and the tapered surface 15. The fillet surface is a curved surface that transitions between the flat front face and the tapered surface 15 of the card.

If the interweaved and staggered cards did not include the taper so that the foot print of each card was constant from one end to the other, the bottom surface of the card that floats on the rotating member would have a larger surface area on one end than on the opposite end that would create an unbalanced force due to the fluid pressure formed from relative rotation. This unbalanced pressure force would cause the cards to twist or tilt and decrease the sealing capability of the card seal. Thus, the taper provides for a constant foot print on the bottom ends of the cards so that the fluid pressure is not unbalanced.

I claim the following:

1. A card seal comprising:

a plurality of leading edge cards interweaved and staggered with a plurality of trailing edge cards;

the leading edge cards and the trailing edge cards being interweaved in a inner end of the cards;

the leading edge cards and the trailing edge cards having a thinner inner end and a thicker outer end; and, the leading edge cards and the trailing edge cards having a tapered lower end such that a foot print of each card is constant along a bottom surface.

2. The card seal of claim 1, and further comprising:

the taper on the leading edge cards face the taper on the trailing edge cards.

3. The card seal of claim 1, and further comprising:

the side of each card opposite from the tapered side is a flat surface.

4. The card seal of claim 1, and further comprising:

the taper is longer on the outer sides than on the inner sides in which the taper decreases to zero.

5. The card seal of claim 1, and further comprising:

the cards are interweaved at around one quarter of the axial length of each card.

6. A card for a card seal, the card comprising:

a front face and a rear face;

a leading edge side and a trailing edge side;

a bottom end having a surface that defines a footprint of the card;

a thickness of the leading edge side being greater than a thickness of the trailing edge side; and, the front face of the card being tapered at a bottom end so that the foot print is constant from the leading edge to the trailing edge.

7. The card seal of claim 6, and further comprising:

the taper is longer on the leading edge side and decreases down to zero on the trailing edge side.

8. The card seal of claim 6, and further comprising:

the rear face of the card is flat.

9. The card seal of claim 6, and further comprising:

the thickness of the leading edge side is around three times the thickness of the trailing edge side.

10. The card seal of claim 6, and further comprising:

the card is rectangular in shape in the front and rear faces with square corners.

* * * * *